US005556007A

United States Patent [19]

Breitsprecher

[11] Patent Number: 5,556,007

[45] Date of Patent: Sep. 17, 1996

[54] PROPORTIONER FOR FLUID SPRAY GUN WITH AIR VALVE CONTROL

[75] Inventor: Charles O. Breitsprecher, Plymouth, Minn.

[73] Assignee: Mattson Spray Equipment, Inc., Rice Lake, Wis.

[21] Appl. No.: 387,450

[22] Filed: Feb. 13, 1995

[51] Int. Cl.[6] ..... B67D 5/52

[52] U.S. Cl. ..... 222/136; 91/305; 222/145.5; 222/249; 222/333

[58] Field of Search ..... 222/129.2, 136, 222/137, 145.1, 145.5, 249, 250, 333; 91/305

[56] References Cited

U.S. PATENT DOCUMENTS

| | | | |
|---|---|---|---|
| 3,734,352 | 5/1973 | Dooley | 222/250 X |
| 3,799,402 | 3/1974 | Meister et al. | 222/129.2 |
| 4,095,628 | 6/1978 | Laub, III | 222/249 X |
| 4,469,251 | 9/1984 | Sperry et al. | 222/145.5 X |
| 4,870,891 | 10/1989 | Shew et al. | 91/305 X |
| 4,993,596 | 2/1991 | Brown | 222/145.5 |

FOREIGN PATENT DOCUMENTS

| | | | |
|---|---|---|---|
| 0315264 | 5/1989 | European Pat. Off. | 222/250 |
| 1137311 | 1/1985 | U.S.S.R. | 222/250 |

*Primary Examiner*—Joseph A. Kaufman
*Attorney, Agent, or Firm*—Jacobson and Johnson

[57] ABSTRACT

An air-operated spray gun for spraying two fluid components in proportional amounts has the fluids fed separately from a pair of fluid cylinders each containing a fluid-operated double-acting piston with the volumes of each cylinder being in accord with the desired proportion of the fluids. The fluids are fed from the cylinders through fluid flow control valves which are switchable between a first position for directing fluid from a fluid source into one end of its associated cylinder and out the opposite end of the cylinder to the spray gun and a second position for directing the fluid out of the one end of the cylinder to the spray gun and into the opposite end of the cylinder from the fluid source. Air control valves instantaneously switch the fluid flow control valves from one position to the other. Sensing devices operate the air control valves when the cylinder pistons reach the ends of their strokes.

3 Claims, 3 Drawing Sheets

PROPORTIONER FOR FLUID SPRAY GUN WITH AIR VALVE CONTROL

FIELD OF THE INVENTION

This invention is directed for use with a pressurized air or pneumatically operated fluid spray gun. More precisely, it is directed toward a spray gun in which two liquid components are sprayed together so they mix in proportionate amounts as they are being sprayed on the article being coated. The invention is primarily directed toward the mechanism for uninterruptedly feeding the fluids to the spray gun in their proportionate amounts.

DESCRIPTION OF THE PRIOR ART

U.S. Pat. Nos. 4,953,754 by Credle and 4,966,306 by Credle, et al., both titled "BEVERAGE DISPENSER SYSTEM USING VOLUMETRIC RATIO CONTROL DEVICE" appear to be the closest prior art. These patented devices are used with a dispenser for a beverage consisting of a mixture of syrup and charged water in a certain prescribed ratio. A cylinder is provided for each of the ingredients with the ratio of the ingredients being determined by the respective ratios of the volumes of the cylinders. Each cylinder has a double-acting fluid or liquid driven piston and a fluid control valve. Each fluid control valve is operated to direct the fluid ingredient being discharged from one end of its associated cylinder to the dispenser while directing the ingredient into the opposite end of the cylinder during one stroke of the piston and then at the end of the stroke being reversed so that the ingredient is fed or inserted into said one end of the cylinder and is discharged from the opposite end of the cylinder and directed to the dispenser during the reverse stroke of the piston. A sensing device determines when the piston reaches the end of each stroke to trigger operation of the fluid control valves to reverse the stroke of the piston.

SUMMARY OF THE INVENTION

The invention is directed for use with proportioners for feeding two different liquid components to an air-operated spray gun with the components being applied generally simultaneously to a surface to be coated or are mixed together when;expel/ed or ejected from the spray gun in prescribed ratios. One concern is that because of the nature of the liquid components and the manner in which they are mixed together or applied, it is important to avoid any possibility of sparking due to an electrical discharge or anything which might be a hazard in the operating environment. The proportioners which feed the two component fluids to the spray gun are somewhat similar in operation to those described above in the aforementioned prior art. One difference is that the instant invention utilizes two separate cylinders with separate pistons but the piston rods are attached together so they move back and forth in unison. Each of the cylinders is coupled to the spray gun by a separate two position liquid control valve each of which operates in the same fashion. In one position the valve directs fluid from a suitable fluid source into one end of its associated cylinder and provides a path for the fluid to flow from the other end of the cylinder to a suitable input of the fluid spray gun. When switched to its other position the liquid control valve provides a path for the fluid to flow from the fluid source into said other end of the cylinder and provides a path for the fluid to flow from said one end of the cylinder into the sine input of the spray gun. The pistons of the cylinders are continuously driven back and forth between the ends of the cylinders and the end of each stroke of the piston is detected by a mechanical sensing device which causes an air control valve to actuate an air operated pilot valve which in turn supplies bursts of air to instantly operate the liquid control valve so that fluid continues from the fluid source to the spray gun without interruption. Air control valves are used to avoid the danger of an electrical spark occurring. The air control valve system provides a positive force for switching the liquid control valves by using a small mount of pressurized air to control the feeding of a larger mount of pressurized air to operate the liquid control valves rapidly even though the movement of the cylinder pistons may be quite slow, thus eliminating conditions which otherwise might cause a stall or interruption of the fluid flow.

DESCRIPTION OF THE PREFERRED EMBODIMENTS

Figure 1:
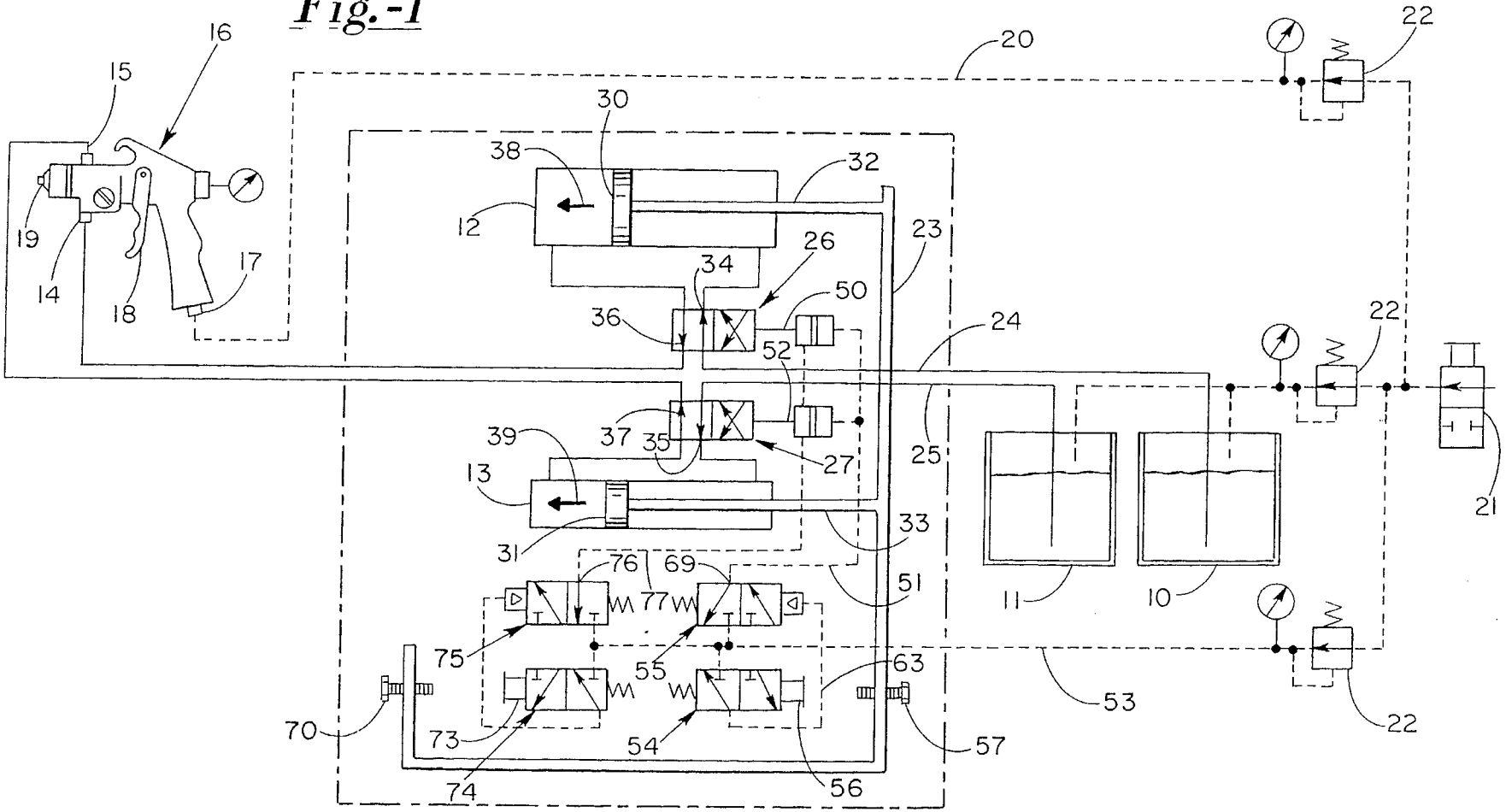
FIG. 1 is a diagrammatic illustration of the functional operation of a system incorporating the teachings of this invention.

In FIG. 1 the fluid or liquid flow paths are shown as solid lines and the paths for the pressurized air is shown by dashed line.

Liquids from suitable and conventional reservoirs or tanks 10 and 11 are fed through respective cylinders 12 and 13, via suitable valving which will be described later, to respective liquid inputs 14 and 15 of a two-component pressurized air spray gun generally designated by reference numeral 16. A two-component spray gun 16 such as illustrated in FIG. 1 is conventional and is commercially available. Conventionally, pressurized air is fed into the intake 17 on the handle of gun 16 and the fluid components are inserted at inlets 14 and 15 into separate fluid chambers. Operation of trigger 18 moves needle-nosed rods in the chambers to eject the fluids so that they are mixed together at the ejection end 19 in the proportionate mount and applied to the surface of an article. Another type of commercially available gun has a single fluid chamber and an attached manifold for mixing together the two fluids in their proportionate amounts before inserting the mixture into the fluid chamber from where it is ejected by operation of the trigger The pressurized air is fed to spray gun 16 via a suitable air conveying line or hose 20 from a suitable air pressure source designated by reference numeral 21. The air pressure source 21 also provides pressurized air in a conventional fashion to the liquid containers or reservoirs 10 and 11. Conventional pressure regulating valves 22 are located in each of the pressurized air conveying lines. The liquid from reservoirs or containers 10 and 11 are respectively fed by suitable conveying lines or conduits 24 and 25 through respective double-acting liquid control valves 26 and 27 into the respective cylinders 12 and 13. Pistons 30 and 31 are respectively located within the chambers of cylinders 12 and 13 and corresponding double-acting piston rods 32 and 33 are connected together by a connecting bar or rod 23 so that they move back and forth in unison.

During one stroke of pistons 30 and 31 in which the liquid control valves 26 and 27 are positioned so that the liquid flows through the valves into one end of cylinders 12 and 13 in a direction shown by arrows 34 and 35, respectively, and out of the other or opposite end of cylinders 12 and 13 in a direction shown by arrows 36 and 37, respectively, pistons 30 and 31 are moved in a direction shown by arrows 38 and 39. The liquid flow is into the righthand end of cylinders 12 and 13 (as observed in FIG. 1) and out of the lefthand end and enters into the respective inlets 14 and 15 of spray gun 16. When pistons 30 and 31 reach the end of the stroke in the direction of arrows 38 and 39, liquid control valves 26 and 27 are operated to be positioned in a reverse or alternate arrangement in which the liquid in input lines 24 and 25 will now be fed into the lefthand end of cylinders 12 and 13 (in a direction opposite of arrows 36 and 37) and the liquid will exit from the fight hand end of cylinders 12 and 13 (opposite the direction of arrows 34 and 35) so that entry ports 14 and 15 on spray gun 16 receive liquid from the rightmost end of cylinders 12 and 13 and pistons 30 and 31 will now be moving left to fight (opposite of arrows 38 and 39). When pistons 30 and 31 reach the rightmost extremity of their stroke, liquid control valves 26 and 27 are operated to return to the first described position so that the flow of liquid is in the manner as described initially hereinabove. This back and forth type operation continues while the gun is being operated.

Figure 2:
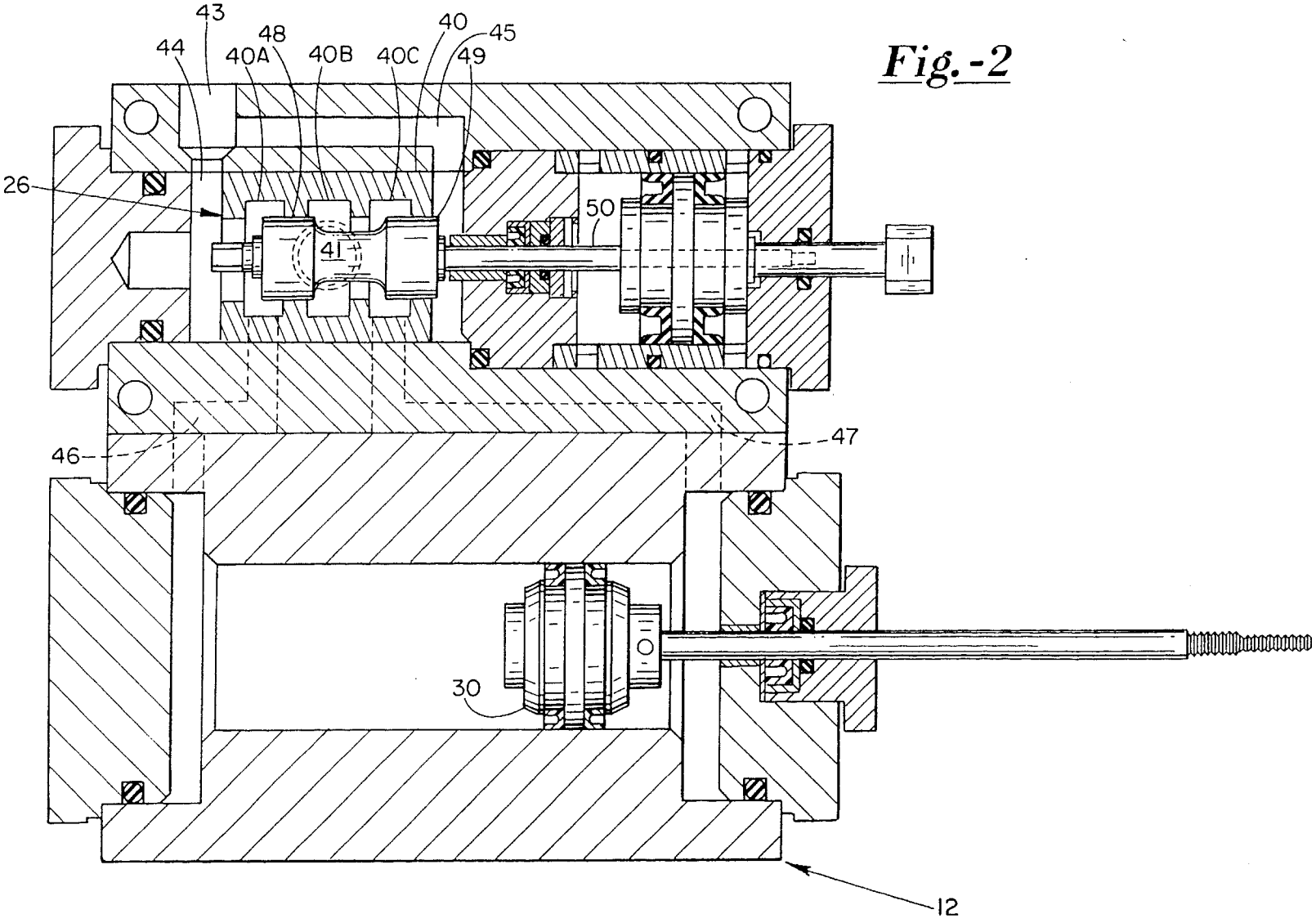
FIG. 2 is a detailed view of the operation of the fluid control valve.

Turning now to FIG. 2, the construction of one of the fluid control valves is shown in greater detail. Since both liquid control valves 26 and 27 are identical and operate in the same fashion, only one will be described. For the purpose of explanation, control valve 26 will be described. Valve body 40 has three interior chambers designated respectively as 40A, 40B, and 40C. The liquid inlet to valve body 40 is shown at 41 by dashed circular lines and is in communication with middle chamber 40B. The liquid outlet is designated by reference numeral 43 and is coupled to input 14 of spray gun 16 by a suitable hose or conduit, not shown. One liquid passageway or conduit to outlet 43 from valve body 40 is shown at 44 and another is shown at 45. A liquid passageway or conduit from valve 26 to one end of associated cylinder 12 is shown at 46 and another liquid passageway or conduit to the other end of cylinder 12 from valve 26 is shown at 47. Left and right valve body members 48 and 49, respectively, are operated to be moved left and right (as observed in FIG. 2) by a common shaft or rod 50. When located in the position as illustrated in FIG. 2 so that body members 48 and 49 are at their rightmost location, flow communication from middle chamber 40B to leftmost chamber 40A is closed off but is opened between chamber 40B and 40C. Therefore, liquid entering valve body 40 through inlet 41 passes from chamber 40B to 40C and then out passageway 47 to the rightmost side of cylinder 12. At the same time, fluid or liquid communication is established between the left side of cylinder 12 through passageway 46 into chamber 40A to passageway 44 to outlet 43 so that the liquid flows from the left side of cylinder 12 to liquid outlet 43 from where it is then carried to inlet 14 on spray gun 16 and piston 30 moves right to left. When shaft 50 is moved leftward, by means which will be described later, valve body members 49 and 48 move leftward so that fluid communication is established between chamber 40B and 40A and cut off between 40B and 40C and flow communication is established between chamber 40C and passageway 45 and closed off between chamber 40A and passageway 44. This results in liquid flow reversal, i.e., the incoming liquid at inlet 41 then passes into chamber 40A from chamber 40B and through passageway 46 into the leftmost end of cylinder 12 and correspondingly the liquid exits out the righthand side of cylinder 12 via passageway 47 to chamber 40C and then to passageway 45 which carries the fluid to outlet 43 and from there it is fed to inlet 14 of spray gun 16.

As illustrated diagrammatically in FIG. 1, shaft or rod 50 associated with liquid control valve 26 is operated by pressurized air carried by conduit or passageway designated by dashed line 51. Liquid control valve 27 similarly has an associated piston or rod 52 which is also operated by pressurized air but since it is operated and functions in the same fashion and for the same purpose as piston 50, only one will be described. Pressurized air from pressurized air source 21 is fed by a suitable passageway or conduit designated by dashed line 53 to a conventional plunger-operated air valve 54 which in turn operates another conventional air valve 55 to control the passage of a lager amount of pressurized air to operate liquid control valve piston 50. Plunger 56 of air valve 54 is spring-loaded to a closed position and is opened when its head 60 is contacted by set screw 57 which is mounted on bar 23 which moves with piston rods 32 and 33 of cylinders.12 and 13. This causes a small mount of pressurized air to be fed from valve 54 to valve 55 through outlet 62 to line 63 to move the normally-closed spring-loaded plunger of valve 55 rightward (as viewed in FIG. 3) to an open position to feed a larger mount of pressurized air to line 51 to operate or move shaft or rod 50 of liquid control valve 26 instantaniously from one position to the other.

Figure 3:
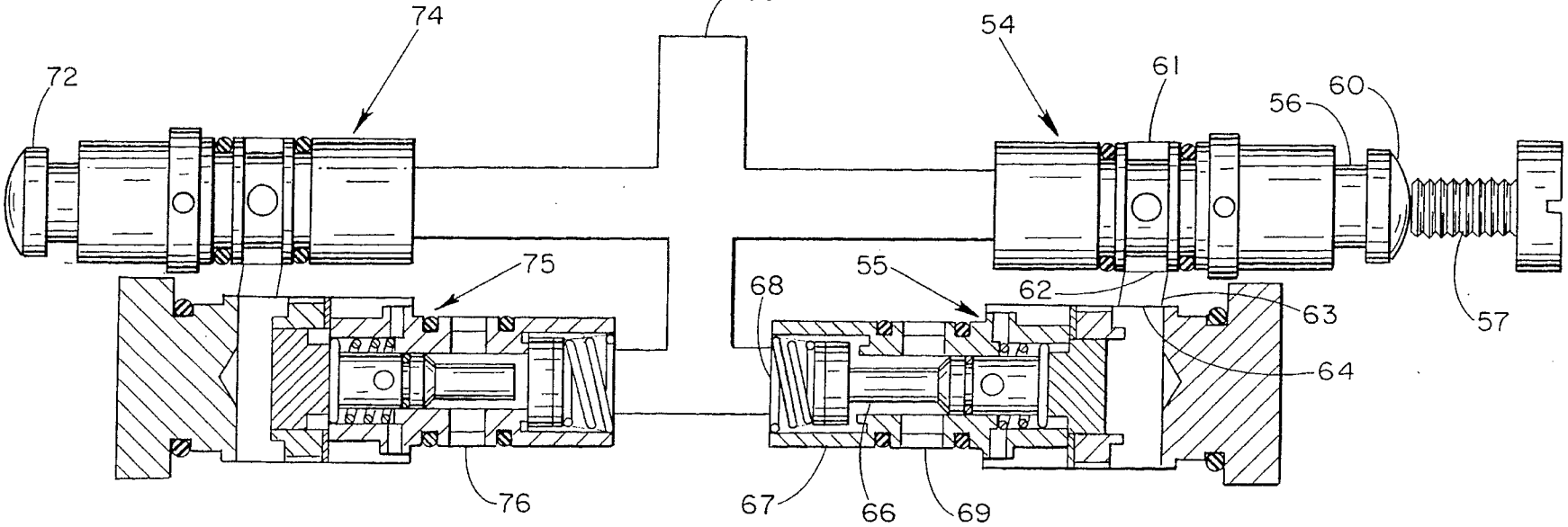
FIG. 3 is a detailed view of the air valves.

Turning now to FIG. 3, the construction and operation of the conventional air valves which are operated to prevent undesirable stalling or interruped fluid flow will now be described in greater detail: A button or pad 60 is attached to the end of plunger 56 of air valve 54. The end of the left-hand travel of pistons 30 and 31 is detected by set screw 57 contacting pad 60 to move plunger 56 sufficiently to open the valve by the valve popper being lifted from its seat, not shown, to allow pressurized air from passageway 53 to enter at an inlet opening, not shown. The pressurized air flows into an annular area 61 and out a port hole 62 into a passage 63 which conveys the pressurized air into an inlet opening 64 of another plunger-operated air valve 55. In general only a relatively small volume of air is transferred or conveyed into valve 55 from valve 54 but sufficient enough to open valve 55 by moving a spring-loaded plunger, generally designated by reference numeral 66, to lift seal 67 off its seal This causes a burst of a large volume of pressurized air from passageway 53 to enter valve 55 at opening 68 and go around the open seat to an outlet opening 69 which is connected to line 51 (FIG. 1). As mentioned earlier, line or passageway 5 1 carries the pressurized air to operate piston 50 associated with liquid control valve 26 so that liquid control valve body members 48 and 49 are instantaneously moved by the burst of air to the leftmost position as viewed in the drawings and as described earlier so that fluid flow continues without interruption or stalling. When the respective pistons 30 and 31 of cylinders 12 and 13 reach the opposite ends of their strokes, set screw 70 which is also carded by connecting bar 23, contacts a button or pad 72 on a piston or spring-loaded rod 73 of an air valve 74, similar to air valve 54, which in turn operates in conjunction with an air valve 75, similar to air valve 55, to feed a burst of pressurized air in a similar fashion to outlet 76 and line 77 to move rods 50 and 52 of respective liquid control valves 26 and 27 instantaneously in the reverse direction to their rightmost positions so that the liquid entering cylinders 12 and 13 now moves pistons 30 and 31 in the reverse direction without stalling or interrupting the fluid flow.

I claim:

1. A proportioner having a pair of fluid cylinders, each cylinder containing a fluid-operated double-acting piston for separately feeding liquid to an air-operated spray gun in proportionate amounts from separate liquid sources during alternate strokes of the piston, the improvement comprising:

a liquid control valve for each cylinder, each liquid control valve having a first position for directing a liquid into one end of its associated cylinder from a liquid source and directing the liquid out the opposite end of its associated cylinder to the spray gun and a second position for directing the liquid out of said one end of its associated cylinder to the spray gun and into the opposite end of its associated cylinder from the fluid source:

means for attaching the cylinder pistons to one another so they move in unison;

sensors for detecting when the cylinder pistons reach the end of each stroke;

a first normally-closed air valve having a first plunger;

means for moving said first plunger to open said first air valve in response to one of said sensors;

a second normally closed air valve having a second plunger, said second air valve in air communication with said first air valve and in air communication with a liquid control valve;

said first air valve when open directing pressurized air to said second air valve to move said second plunger to open said second air valve;

said second air valve when open directing a burst of pressurized air to said liquid control valve to move said liquid control valve from one position to the other instantaneously.

2. The proportioner as described in claim 1 wherein the volume of air directed by said first air valve to said second air valve is substantially less than the volume of the burst of air directed by said second air valve to said liquid control valve.

3. The proportioner as described in claim 1 wherein said sensors comprise a pair of set screws coupled to move with said cylinder pistons, each set screw arranged to contact and move the plunger of an associated first air valve to open its associated air valve.

* * * * *